United States Patent [19]

Goossen

[11] Patent Number: 4,550,934

[45] Date of Patent: Nov. 5, 1985

[54] TICKLER SYSTEM WHEREIN AN ITEM OF DATA IN CARD FILE IS READILY ACCESSIBLE BY EITHER OF TWO CRITERIA, SUCH AS DATE AND SUBJECT MATTER

[76] Inventor: Levi H. Goossen, 224 E. 7th St., Newton, Kans. 67114

[21] Appl. No.: 500,354

[22] Filed: Jun. 2, 1983

[51] Int. Cl.[4] ..... B42F 17/00; B42F 21/00; A47B 63/00

[52] U.S. Cl. ..... 283/37; 283/35; 312/183

[58] Field of Search ..... 283/35, 36, 37; 312/183, 50

[56] References Cited

U.S. PATENT DOCUMENTS

| | | | |
|---|---|---|---|
| 2,042,516 | 6/1936 | Elliott | 312/183 |
| 2,325,039 | 7/1943 | Chesler | 312/50 |
| 3,206,269 | 9/1965 | Curtis et al. | 312/183 |
| 3,221,890 | 12/1965 | Wassell | 312/183 |
| 3,528,716 | 9/1970 | Lapertosa | 312/183 |
| 4,325,595 | 4/1982 | Solomon | 312/183 |

*Primary Examiner*—Paul A. Bell
*Assistant Examiner*—Paul M. Heyrana, Sr.
*Attorney, Agent, or Firm*—H. Karl Saalbach

[57] ABSTRACT

A tickler file containing index cards arranged by date and containing data slips filed under the index cards in accordance with the date on the index cards. In order to permit ready access to the data slips in the tickler file by subject matter, rather than by date, the data slips are wider than the index cards and data slips and index cards are stored in a wide sidewise slanted file tray, so that all rest on the bottom and settle against the lower side wall of the file tray. Indicia relating to subject matter is applied to the edge of the data slips which project beyond the index cards. Said indicia can readily be scanned for particular subject matter by riffling the projecting side edges of the data slips.

5 Claims, 3 Drawing Figures

TICKLER SYSTEM WHEREIN AN ITEM OF DATA IN CARD FILE IS READILY ACCESSIBLE BY EITHER OF TWO CRITERIA, SUCH AS DATE AND SUBJECT MATTER

SUMMARY

A tickler system for reminding of upcoming dates for the doing of tasks utilizes, in combination, three components: (1) Plural rectangular data slips of a given size. (2) Rectangular index cards of somewhat lesser width for catagorizing those data slips filed behind an individual index card. (3) A sidewise tilted file tray for holding the data slips and index cards, seated on the sidewise slanted flow and settled against slanted side wall of the file tray on the lowermost side thereof.

The index cards have tabs projecting above the level of the data cards, whereby readily visable "date" indicia can be applied to the tabs, and whereby the data slips filed behind an index card, in accordance with "date", may readily be examined.

The data slips, being wider than the index cards, each have a portion which projects beyond the width of the index cards. The projecting portion of each data slip furnishes a field on which subject matter identification may be applied. The projecting portions of the date slip can readily be riffled at their side edges to scan the indicia on said fields and thereby locate those data slips pertinent to particular subject matter.

The indicia on a plurality of the data slips is filled in at one time in the desired number of multiple copies by using padded carbonless duplicating paper. Thus, identical data slips can readily be prepared for filing under differing dates.

VIEWS OF DRAWING

DETAILED DESCRIPTION

Figure 1:
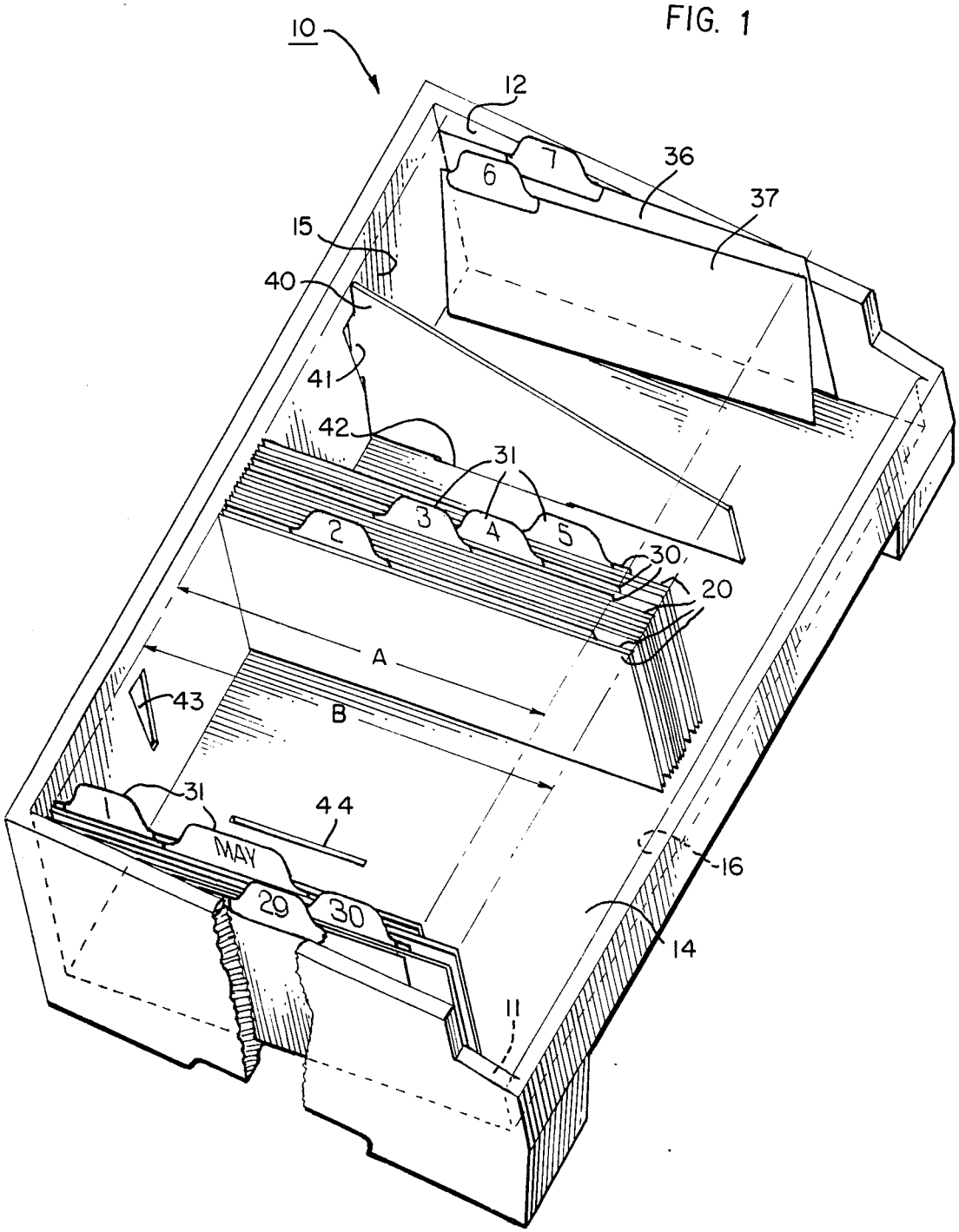
FIG. 1 is a general top-front view of the tickler file, with a portion of the file tray broken away.
Figure 2:
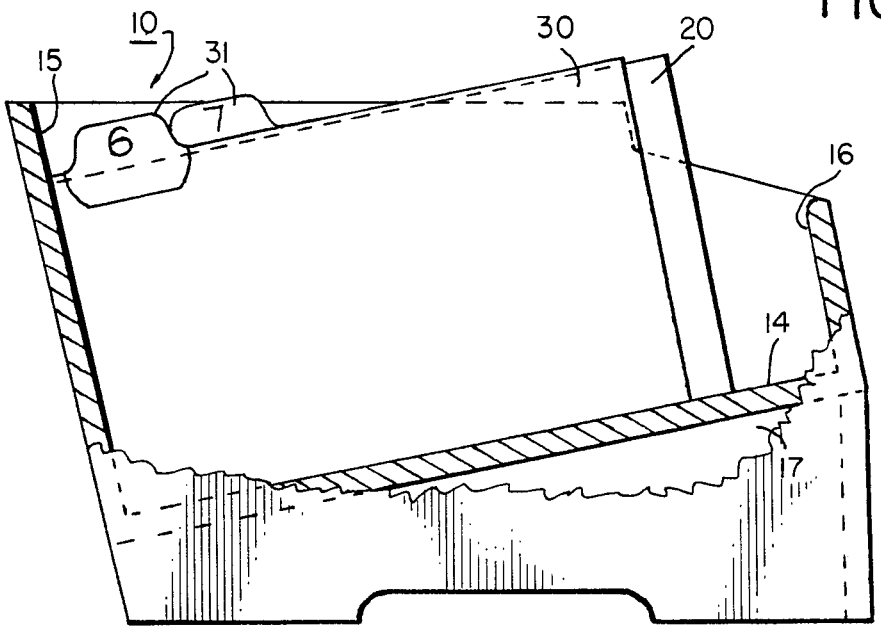
FIG. 2 is a front view of the tickler file, with a portion of the file tray broken away.

Referring to FIGS. 1 and 2, 10 is a file tray adapted to rest on a horizontal surface, such as a desk. File tray 10 has an open top, defined by vertical front and back interior walls 11 and 12, a sidewise sloping bottom 14, a left interior side wall 15 which is perpendicular to bottom 14 and a right interior side wall 16 which is also perpendicular to bottom 14. File tray 10, as illustrated, may be taken to be of molded plastic, or of paste board construction, or of any other suitable construction material.

As best seen in FIG. 2, the slope of bottom 14 provides a wedge shaped space 17 between the tray 10 and the surface on which it rests. Space 17 is used to store a clipboard and pack of padded carbonless duplicating paper which is used to prepare the slips stored in file tray 10, as explained further below.

The file tray 10 is used to hold a large number of data slips 20, appropriately filed behind index cards 30. The index cards are of a given size, say standard 3 by 5 inch, while the data slips are of nominally the same height as the index cards but wider, for example, 3 by $5\frac{1}{2}$ inches.

The width of the index cards 30 is shown in FIG. 1 as A, while the greater width of the data slips is shown as B. In FIG. 2 the height of the index cards 30 is shown as being slightly greater than the height of the data slips 20, in order to depict their respective top edges separately.

It will be noted, from FIG. 2, that the sidewise slope of bottom 14 is of sufficient gradient to cause the data slips 20 and the index cards 30 to individually settle against interior side wall 15. As a result, the indicia tabs 31 of the index cards 30 project above the common overlap between data slips 20 and index cards 30, in the same way the index cards in a library card catalog project above the book cards filed behind and between the index cards.

Thus, the data slips can be filed readily in the card tray 10 according to a classification system determined by the tabs 31 of the index cards 30. In FIG. 1 the index cards 30 are depicted as representing a classification sequence of Month and Date.

At the same time, the right edges of data slips 20 project beyond the right edges of index cards 30, thus providing a uniform pack of data slips which can be riffled readily along the projection side edge, to enable a user to quickly scan the narrow fields of data slips 20 projecting beyond the right edge of the index cards 30. Those narrow fields may be suitably marked with data information which is searchable for a characteristic different than the characteristic, such as month and day, determined by the index cards 30.

One of the index cards 30, namely 36, is shown in FIG. 1 as pushed up flat against the vertical back interior wall 12, while another index card 37, is shown slumped down and likely to slide down onto the sideways sloping bottom 14. This would occur because the two index cards 36 and 37 are not packed tightly enough to support each other. In order to prevent loosely packed index cards 30 and loosely packed data slips 20 from flopping or falling down, a series of divider partitions 40, only one of which is shown in FIG. 1, are provided. Each of the partitions 40 has a side tab 41 on its left edge and a bottom tab 42 on its bottom edge, which tabs key into corresponding recesses 43 and 44, respectively. The thickness of bottom tab 42 is slightly less than the width of a corresponding recess 44, thereby permitting the divider partition 40 to pivet back and forth, as determined by the radial arc of recess 43. The small amount of pivoting action provides an agreeable looseness in the part of the file being examined, without destroying the mutual support data slips 20 and index cards 30 give to each other.

Figure 3:
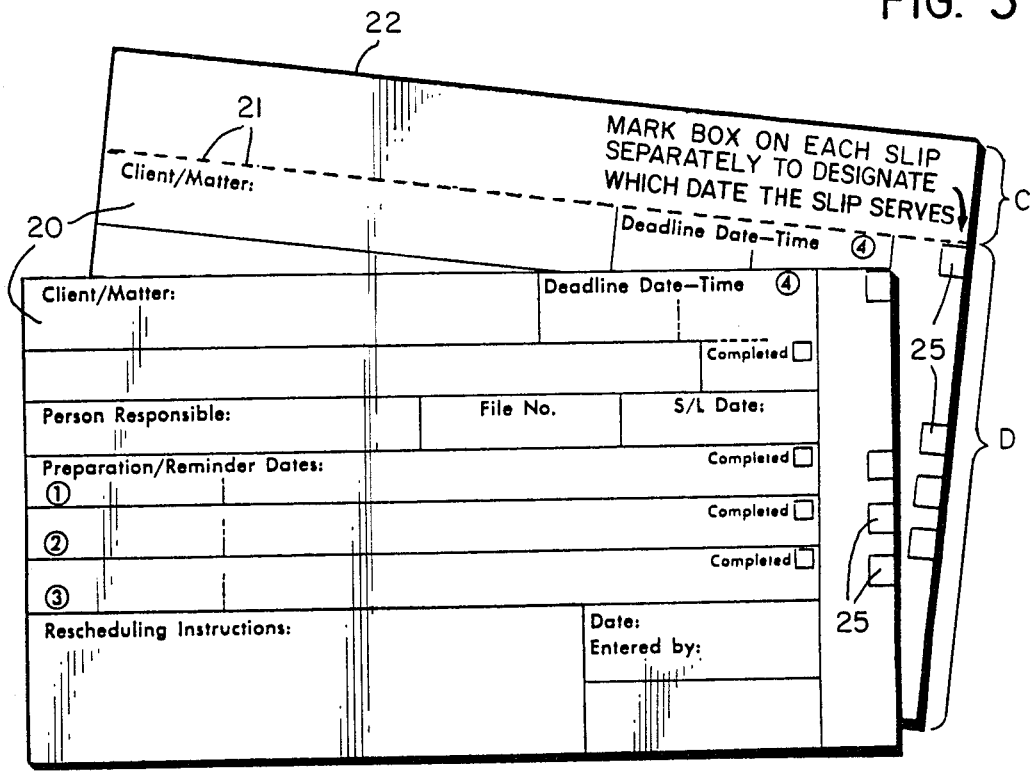
FIG. 3 is a top view of a pad of data slips, with one data slip torn off.

A possible format for the data slips 20 is shown in FIG. 3. It is suitable to use in a lawyers office or a tax office in which statutory periods are frequently encountered. A statutory period, such as that set by a statute of limitations, is one which sets a deadline before which action must be taken to avoid loss of rights or to avoid penalties. When the statutory period expires without appropriate action having been taken, the layman's expression "deadline" is indeed descriptive.

Before the deadline arrives, it is necessary to prepare, usually in a number of stages. Three stages of preparation before the deadline are often necessary.

The data slips 20, as shown in FIG. 3, have a preprinted format adapted for use in a situation wherein a deadline exists and there are no more than three reminder dates, previous to the deadline, for various stages of preparation. These data slips have an upper portion C, which is attached to a lower portion D by a weakening series of perforations 21. The upper portion C of each data slip 20 is padded at its upper edge 22 to the upper edges 22 of all the other data slips 20 beneath the top data slip 20.

The upper portion C of the pad of data slips is adapted to be clamped onto a conventional clipboard, so that as successive lower portions D of the data slips are torn off the pad, it will still remain anchored to the clipboard.

FIG. 3 shows a lower portion D of a data slip 20 torn off and lying partly on top of the remainder of the pad of data slips.

It will be noted that the top line of the data slip 20 in FIG. 3 provides space for entering the important data concerning the identity of the client and matter involved and the deadline date. The deadline might be the last date to take an appeal, the normal day to pay federal income taxes (April 15th), etc.

This deadline date, however, is not the date on which work is to begin, for one should never work against a deadline without a safety margin. For example, in the case of an appeal, there would be several stage of preparation. First, take an appeal and pay the appeal fees; second, research the law and prior case record; Third, prepare and review appeal brief. A fourth stage would be the filing of the completed appeal brief and serving copies thereof on other parties.

Four stages requires that four dates be posted for attention. Accordingly, a hard writing platten is slipped, underneath the proper number (four) of data slips 20, of the pad of data slips, so that a writing instrument would make one original and three no-carbon-required duplicates, without leaving any marks on the remaining data slips of the pad, under the hard writing platten. The four data slips 20 are then simultaneously marked with the required data.

It will be noted, from FIG. 3, that the format of data slip 20 provides for four reminder dates which are sequentially numbered (1), (2), (3) and (4) with (4) being the latest and deadline date and the other three reserved for preparation and reminder dates. Each line is filled in with the appropriate data and, except for the deadline date, the action to be taken at that time. For the deadline date only the date is filled in, for the action to be taken is apparent from the client and matter date. Each of the four dates also has a "completed" box, which can be checked after the required action has been taken to indicate the fact of completion.

A space is also provided for insertion of the statute of limitations date. Some deadlines, such as those for tax returns or some actions before government agencies can be postponed by the timely filing of a suitable paper but periods set by statutes of limitations cannot be extended. Thus this information is useful on the data slip to caution about the absolute inflexiblity of a deadline.

In the vertical field at the right side of the data slip 20, which field projects beyond the index cards 30, the name of the client or matter is written, running up and down the height of the data slip.

The family of four identical data slips, after having been filled in as discussed above and filed in with any other desired data (as suggested by the format of the data slips shown in FIG. 3) is separated from the pad into four individual slips. A different one of the square boxes 25 is then checkmarked on each data slip. The checkmarked box indicates which date the respective data slip serves.

The four originally identical data slips, each now individually distinctive by virtue of the checkmarking of a box, are filed in the tickler file 10 in accordance with the date indicated by the checkmark.

Any data slip or family of data slips in the file tray 10 can be easily located simply by "scanning" the side scanning index in the approximate date location where any slip belonging to the family might be located. This is done by simply running the right thumb across the margins of the data slips which protrude or extend out past the edge of the index cards. As the data slips are bent, the client names are visible without removal of the data slips from the file or fingering through from the top. All data slips refer to the location of the rest of the same family of data slips, for all data slips of a family are duplicates, except for the marking of boxes 25.

This side scanning feature will find frequent use in resolving doubling up on monitoring and in verifying whether an item has already been monitored and for what date. Both situations require the monitor clerk to be able to locate the applicable data slips quickly.

The side scanning index serves the additional function of showing whether the data slip is a deadline or preparation data slip, and if a preparation data slip, then which of three possible warning dates it protects.

It will be noted, from FIGS. 1 and 2, that the file tray 10 is wider than the width of the data slips 20. This provides a space between inner wall 16 and the right edge of the data slips 20. This space makes it easier to riffle the edge of the data slips 20.

The description above sets forth one of many possible embodiments of the invention, which also has applications beyond use as a tickler file.

For example, it is useful in avoiding conflicts of interest which might arise if an attorney takes on a new client. If the new client is, say, Smith, and wishes to be represented in a law suit styled as Brown et al versus Smith, the attorney would utilize the invention as follows:

A form, which is either blank or suitably lined, of padded carbonless duplicating paper is filled in with the identification heading Brown et al versus Smith in the necessary numbers of duplicates. The number of duplicates is determined by the number of entities whose interests in the action are aligned with Brown or adverse to Smith. Thus, Brown, each of Brown's co-plaintiffs, and each of all known third parties who have interests in common with Brown or adverse to Smith would require an individual slip.

After the required number of slips have been marked at one time with the heading Brown et al versus Smith, the slips are separated. In the projecting field at the right end of each slip the corresponding one of the single entities would be noted, and the thus noted slip would be filed according to the single entity behind an index card in an alphabetical file. Thus, the individual slip for Brown as a single entity would be filed behind the "B" index card, but the various slips between the "B" and "C" index cards need not be further alphabetized.

The attorney would note however, by riffling the edge of the data slips filed under "B", whether any of those slips were also makred "Brown". If so, the attorney is forwarned that there might be a conflict of interests, should be accept Smith as a client, since Brown is already a client of his firm or has had an interest indexed which interest may be adverse to Smith.

Another use of the invention is for scheduling work in preparation for an annual meeting. Thus, there should be sequential and suitably timed reminders about planning, hiring of a hall, printing a program, etc.

As disclosed, the invention is convenient to use by a person who is right handed. The invention is easily adapted for use by left handed persons by turning the file tray 180° about a vertical axis and using padded carbonless duplicating forms which are either blank or printed appropriately for left handed use. It is noted that the printing on the pads, although useful, is not essential.

I claim:

1. In combination, an open top tray of generally rectangular configuration; having bottom, sides and ends:

means for supporting said tray on and above a horizontal surface with the tray slanted sideways with respect to said horizontal surface;

a series of rectangular index cards of a given height and given width standing edgewise on the bottom of said open top tray;

a tab arising from the top edge of each index card;

a series of rectangular data slips of nominally the same height as said index cards and of width greater than said given width by a given margin width, said data slips also standing edgewise on the bottom of said open top tray;

said index cards and said data slips being intercalated;

the amount of said sideways slant being sufficient to urge index cards and data slips to individually settle, while standing edgewise on said bottom, against the lower slanted side of said open top tray;

the interior distance between the said side walls being greater than the width of the data slips by a given clearance distance;

whereby the lower side edges of said index cards and data slips tend to be in alignment with each other and with said lower side; and whereby the upper side edges of said data slips tend to be aligned and to project beyond the upper side edges of said index cards by the said given margin width;

whereby the said upstanding tabs provide means to search said data slips in accordance with one system of classification in accordance with indicia on said tabs and whereby the portions of said data slips which project beyond the index cards and the presence of said given clearance distance provide means to readily riffle the said upper side edges of said data slips to locate items classified in accordance with another system of classification, in accordance with data on the projecting upper side edges of said data slips.

2. The combination of claim 1 in which the dihedral angle between said bottom of said open top tray and said horizontal surface is approximately 11 degrees.

3. The combination of claim 1 in which said index cards are standard 3 inch by 5 inch index guides.

4. The combination of claim 1 in which said index cards are standard 4 inch by 6 inch index guides.

5. The combination of claim 1 in which the tabs of said index cards contain indicia relating to date.

* * * * *